United States Patent [19]

Miller

[11] Patent Number: 4,733,163

[45] Date of Patent: Mar. 22, 1988

[54] DIGITALLY CONTROLLED CURRENT SOURCE

[75] Inventor: Ira Miller, Tempe, Ariz.

[73] Assignee: Motorola, Inc., Schaumburg, Ill.

[21] Appl. No.: 7

[22] Filed: Jan. 2, 1987

[51] Int. Cl.[4] ..... G05F 3/20

[52] U.S. Cl. ..... 323/317; 323/316

[58] Field of Search ..... 323/315, 316, 317

[56] References Cited

U.S. PATENT DOCUMENTS 4,408,190 10/1983 Nagano ..... 323/315

4,565,960 1/1986 Takata et al. ..... 323/317

OTHER PUBLICATIONS

IBM Technical Disclosure Bulletin, vol. 25, No. 11B, Apr. 1983, pp. 6068 and 6069.

*Primary Examiner*—Patrick R. Salce

*Assistant Examiner*—Judson H. Jones

*Attorney, Agent, or Firm*—Michael D. Bingham

[57] ABSTRACT

There is disclosed a current source for producing an output current the magnitude of which is controlled in a predetermined manner which comprises first and second constant current sources for supplying first and second currents, a current mirror circuit including first and second resistors through which the first and second current respectively flow, the current mirror circuit having an output to which a current amplifier is coupled and which provides the output current when rendered operative, the output current also flowing through the second resistor and switch means coupled to the first resistor which is responsive to an applied control signal for sourcing a current of predetermined magnitude to said first resistor to thereby cause excess current from said first constant current source to flow to said current amplifier to render the same operative.

9 Claims, 3 Drawing Figures

DIGITALLY CONTROLLED CURRENT SOURCE

BACKGROUND OF THE INVENTION

The present invention relates to current sources and, more particularly, to a current source for providing an output current the magnitude of which is digitally controlled.

There are many uses for a current source for providing an output current the magnitude of which is controlled by an applied input signal thereto. For example, personal computers require keyboards for inputting ASCII (American Standard Code for Information Interchange) alpha-numeric information to the main computer unit. Most keyboards consist of several Light Emitting Diode status indicators and an audio tone generator for producing various audible status indications among other things.

There is need for a current source that can be interfaced with a microprocessor unit (MPU) in order to generate the status indications an output logarithmic current function, in response to receiving digital control signals from the MPU.

SUMMARY OF THE INVENTION

Accordingly, it is an object of the present invention to provide an improved current source.

It is another object of the present invention to provide an improved integrated current source.

Still another object of the present invention is to provide a current source for providing an output current the magnitude of which is varied in response to receiving digital input signals thereto.

In accordance with the above and other objects there is provided a current source for producing an output current the magnitude of which is controlled in a predetermined manner which comprises first and second constant current sources for supplying first and second currents, a current mirror circuit including first and second resistors through which the first and second current respectively flow, the current mirror circuit having an output to which a current amplifier is coupled and which provides the output current when rendered operative, the output current also flowing through the second resistor and switch means coupled to the first resistor which is responsive to an applied control signal for sourcing a current of predetermined magnitude to said first resistor to thereby cause excess current from said first constant current source to flow to said current amplifier to render the same operative.

DETAILED DESCRIPTION OF THE PREFERRED EMBODIMENT

Figure 1:
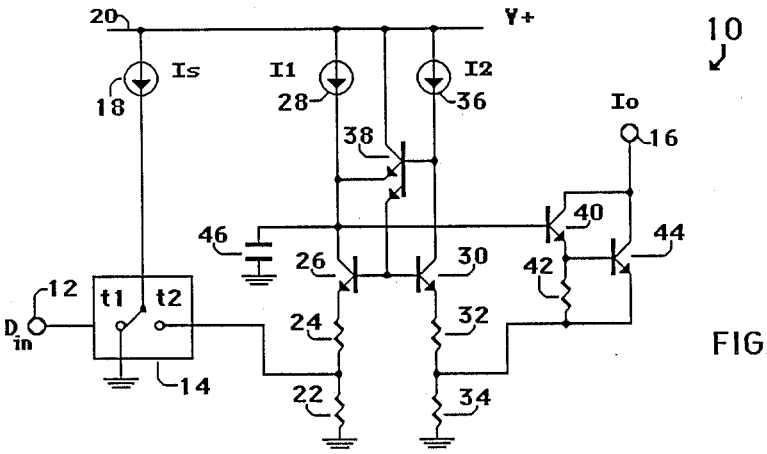
FIG. 1 is a schematic diagram illustrating the controlled current source of the present invention.

Controlled current source 10 of the present invention as illustrated in FIG. 1 receives a control signal Din at input 12 which controls switch means 14 to generate an output current Io at output 16. Typically, Din is a digital control signal having logic one and logic zero levels.

Whenever Din is a logic one switch means 14 is toggled to terminal t1 and the current Is sourced from constant current source 18, which is coupled between power supply conductor 20 and switch means 14, flows directly to ground. However, when Din is at a logic zero state Is is sourced to resistor 22 as switch means 14 is toggled to terminal t2. Resistor 22 is coupled via resistor 24 to the emitter of NPN transistor 26. The collector of transistor 26 is coupled to constant current source 28 the latter of which sources a current I1 to the collector of the former. The base of transistor 26 is coupled to the base of transistor 30 the emitter of which is coupled via resistor 32 to resistor 34 to ground. The collector of transistor 30 is coupled to constant current source 36 which sources a current I2 therefrom. It should be understood that resistors 24 and 32 are not required for the operation of current source 10 but, as will be explained later, are utilized if it is desired to make the ratio between output current Io and the current Is greater than one. Transistor 38 which has its collector coupled to power supply conductor 20 has its base coupled to the collector of transistor 30 and has a pair of emitters the first of which is coupled to the base of transistor 30 and the other of which is coupled to the collector of transistor 26.

Transistors 26, 30 and 38 in conjunction with resistors 22, 24, 32 and 34 function as a current mirror as understood with transistors 30 and 38 forming a semiconductor diode means whereby the current flowing through transistor 30 is mirrored by transistor 26. The output of the current mirror is taken at the collector of transistor 26 and is coupled to the base input of transistor 40. Transistors 40 and 44 along with resistor 42 form a well known Darlington current amplifier with the output thereof being coupled to output terminal 16. The interconnection of resistor 42 and the emitter of transistor 44 is coupled to the top of resistor 34. Capacitor 46 which is coupled between the collector of transistor 26 and ground establishes the dominant pole to inhibit undesirable oscillations. As thus described current source 10 is suited to fabricated in integrated circuit form.

In operation, assuming I1 equals I2, in a quiescent state switch means 14 is in the position shown such that no current is sourced to resistor 22 wherein transistor 26 sinks all of the current I1. Hence, there is no excess base current drive to the input of transistor 40. In this condition both transistors 40 and 44 are maintained in a non-conducting state and Io is equal to zero. In response to the control signal Din changing logic level states from the quiescent condition switch means 14 will be toggled such that the current Is is now sourced to resistor 22. Transistor 26 will be de-biased by the additional voltage drop developed across resistor 22 as a result of Is flowing therethrough. Thus, transistor 26 no longer can sink all of the current I1 supplied from constant current source 28. Therefore excess base current drive is available from the output of the current mirror to turn on transistors 40 and 44 of the Darlington current amplifier and the output current Io now flows through the transistors to be sourced to resistor 34. The output current Io will increase to a value to cause a voltage drop across resistor 34 to equal that developed across resistor 22. By ratioing the degeneration resistors current amplification results wherein Io can be increased, for example, with respect to Is. For instance, by making resistors 22 and 32 equal and ten times larger in value than resistors 24 and 34 (also of equal value) the magnitude of Io is equal to ten times the magnitude of Is.

Figure 2:
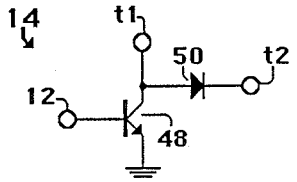
FIG. 2 is a schematic diagram illustrating a switch circuit used in the controlled current source of FIG. 1.

Referring to FIG. 2 switch means 14 is illustrated as including NPN transistor 48 having a base coupled to input 12 and its collector-emitter conduction path coupled between terminal t1 and ground while the collector is also coupled via diode means 50 to terminal t2. Thus, in response to a logic one level signal applied to input 12 transistor 48 is rendered conductive to sink all of the current Is to ground. Correspondingly, transistor 48 is turned off is a logic zero is applied to input 12 which permits diode 50 to be forward biased to source Is to terminal t2.

Figure 3:
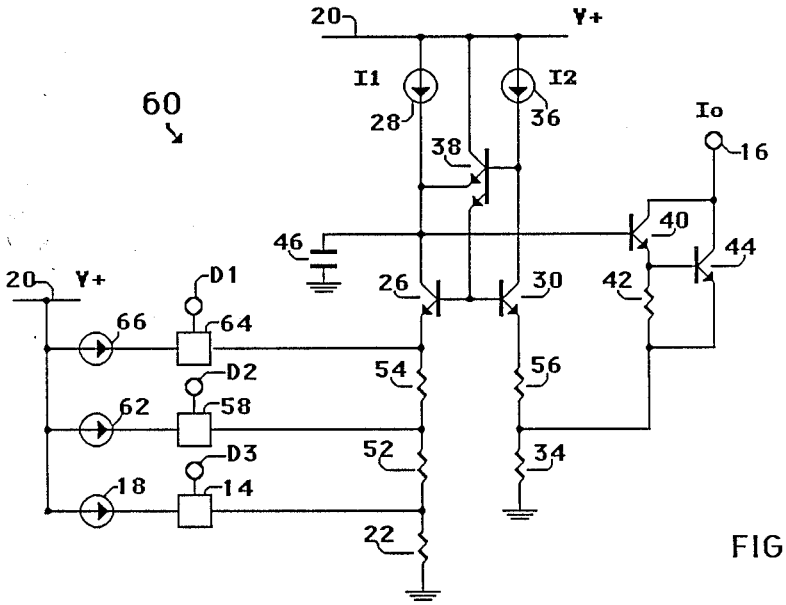
FIG. 3 is a schematic diagram illustrating another embodiment of the controlled current source of the present invention.

Turning now to FIG. 3 there is shown current source 60 which operates in the same manner as described above but which is used to produce a synthesized logarithmic output current function. It is understood that components of current source 60 corresponding to like components of current source 10 are designated by the same reference numbers. Additional emitter degeneration resistors 52 and 54 are series connected between the emitter of transistor 26 and resistor 22 while resistor 56 is series connected between the emitter of transistor 30 and resistor 34. In general the total resistance of resistors 22, 52 and 54 will equal the resistance of resistors 34 and 56 so that in the quiescent condition transistors 26 and 30 are balanced to sink the currents supplied from constant current sources 28 and 36. Controlled current source 60 includes switches 58 and 64 in addition to switch 14 which are digitally selectable to steer current references 18, 62 and 66 to resistors 22, 52 and 54 respectively as described above. Hence, in response to a digital input code to inputs D1, D2, and D3 different values of output current can be derived as transistor 26 is de-biased accordingly. In this manner an approximate logarithmic transfer function can be established between the digital input code and output current Io which, may for instance, be utilized to drive an electro-accoustic transducer to generate audible tones.

Hence, what has been described is a novel digitally controlled current source which is responsive to a digital control signal supplied thereto for generating an output current of a predetermined magnitude.

What is claimed is:

1. Current source for providing an output current the magnitude of which is controlled in a predetermined manner, comprising:

constant current source means for providing first, second and third currents at respective outputs;

a current mirror circuit coupled to said constant current source means and including first and second resistors through which said first and second currents flow respectively, said current mirror having an input and an output;

first switch means coupled to said constant current source means for steering said third current through said first resistor in response to receiving a control signal supplied to an input thereof; output circuit means coupled between said output of said current mirror and said second resistor and having an output, said circuit means being responsive to said third current being steered through said first resistor for providing the output current, said output being an output of the current source.

2. The current source of claim 1 wherein the output current of the current source also flows from the output of said output circuit means through said second resistor such that the magnitude thereof increases to a value proportional to said current steered to said first resistor.

3. The current source of claim 2 wherein said current mirror circuit includes:

a first transistor having an emitter, a collector and a base, said emitter being coupled to said first resistor, said collector being coupled to said constant current source means at said output of said current mirror circuit; and first semiconductor diode means for coupling said constant current source means to said second resistor at said input of said current mirror circuit; and conductive means for coupling the base of said first transistor to said semiconductor diode means.

4. The circuit of claim 3 wherein said output circuit means includes a Darlington current amplifier circuit.

5. The circuit of claim 4 wherein said semiconductor diode means includes:

a second transistor having an emitter, a collector and a base, said emitter being coupled to said second resistor, said collector being coupled to said second constant current source and said base being coupled to said base of said first transistor; and a third transistor having an emitter, a collector and a base, said emitter being coupled to said base of said second transistor, said collector being coupled to a first power supply conductor and said base being coupled to said collector of said second transistor.

6. The circuit of claim 5 wherein said current mirror circuit includes third and fourth resistors, said third resistor being coupled between said emitter of said first transistor and said first resistor and said fourth resistor being coupled between said emitter of said second transistor and said second resistor.

7. The circuit of claim 6 wherein said first switch means includes:

a fourth transistor having an emitter, a collector and a base, said emitter being coupled to a second power supply conductor, said base being coupled to said input of said first switch means and said collector being coupled to said constant current source means;

second semiconductor diode means coupled between said collector of said fourth transistor and the interconnection between said second and said third resistors.

8. The circuit of claim 7 including:

a fifth resistor coupled between said emitter of said first transistor and said third resistor;

second switch means coupled to the interconnection of said fifth and said third resistor which is responsive to a control signal applied thereto for steering a current of predetermined magnitude to said third resistor; and third switch means coupled to said emitter of said first transistor which is responsive to a control signal applied thereto for steering a current of predetermined magnitude to said fifth resistor.

9. A current source for providing a logarithmic output current at an output, comprising:

a plurality of constant current sources each providing a substantially constant current;

a current mirror circuit having an input and output each of which are coupled to a respective one of said plurality of current sources and including first and second current conduction paths each of which comprise a plurality of series connected resistors:

at least two switch means each coupled between respective other ones of said plurality of constant current sources and a selected interconnection between a respective pair of said series connected resistors in said first current conduction path, said at least two switch means being responsive to control signals applied at respective inputs thereof for steering currents to said interconnections; and an amplifier coupled between said output of said current mirror circuit and an interconnection between two of said plurality of series connected resistors in said second current conduction path and including an output coupled to the output of the current source at which is provided the output current in response to said currents being steered to said current mirror circuit from said at least two switch means.

* * * * *